US005606937A

United States Patent [19]

Calhoun

[11] Patent Number: 5,606,937

[45] Date of Patent: Mar. 4, 1997

[54] IN-BLOCK COOLING ARRANGEMENT

[75] Inventor: Keith A. Calhoun, Columbus, Ind.

[73] Assignee: Cummins Engine Company, Inc., Columbus, Ind.

[21] Appl. No.: 587,544

[22] Filed: Jan. 17, 1996

[51] Int. Cl.[6] ..... F01M 5/00; F02B 75/18

[52] U.S. Cl. ..... 123/41.28; 123/41.33; 123/196 AB; 184/104.3

[58] Field of Search ..... 123/196 AB, 41.28, 123/41.33; 184/104.3

[56] References Cited

U.S. PATENT DOCUMENTS

| | | | |
|---|---|---|---|
| 1,310,251 | 7/1919 | Russell . | |
| 1,931,935 | 10/1933 | Paugh . | |
| 2,063,782 | 12/1936 | Barnes . | |
| 2,525,191 | 10/1950 | Warrick et al. . | |
| 2,623,612 | 12/1952 | Scheiterlein . | |
| 4,004,634 | 1/1977 | Habdas | 184/104.3 |
| 4,041,697 | 8/1977 | Coffinberry et al. . | |
| 4,426,956 | 1/1984 | Patel | 123/196 AB |
| 4,665,867 | 5/1987 | Iwamoto et al. | 123/41.28 |
| 4,793,302 | 12/1988 | Osborne et al. | 123/196 AB |
| 5,477,817 | 12/1995 | Hufendiek et al. | 123/196 AB |
| 5,529,097 | 6/1996 | Okubo | 123/41.28 |

FOREIGN PATENT DOCUMENTS

| | | | |
|---|---|---|---|
| 476042 | 4/1951 | Italy | 123/41.33 |
| 4-103826 | 4/1992 | Japan . | |

*Primary Examiner*—Erick R. Solis

*Attorney, Agent, or Firm*—Woodard, Emhardt, Naughton, Moriarty & McNett

[57] ABSTRACT

A dual oil cooler arrangement for positioning in a tapered coolant flow cavity of a diesel engine block includes a pair of virtually identical oil coolers each of which are elongated and which are positioned in an end-to-end configuration extending substantially the entire length of the diesel engine block. The front oil cooler has a front oil inlet and a rear oil outlet. The rear oil cooler has a rear oil inlet and a forward oil outlet. A flow conduit network connects the oil inlets in a parallel flow pattern with a supply source of oil while the oil outlets are connected with an oil filter. The tapered coolant flow cavity in cooperation with the two oil coolers creates balanced and uniform coolant flow to each cylinder. There is a reduction in conduit bends and contraction and expansion points by this flow network. The two oil outlets are positioned near the midpoint of the engine block and this enables the cooled and filtered oil to be introduced into the main oil rifle at a more centralized location. The dual oil cooler design provides less pressure drop. The result is better balance and greater uniformity in the delivery of cooled lubricating oil to critical engine components.

15 Claims, 9 Drawing Sheets

IN-BLOCK COOLING ARRANGEMENT

BACKGROUND OF THE INVENTION

The present invention relates in general to cooperating coolant and oil flow path configurations for a diesel engine and the corresponding structural components which are required. Related to and comprising part of the present invention are the oil cooler configuration, the coolant manifold design in the block and the cooler cover which provides various flow paths for the oil. More specifically the present invention relates to the use of two separate oil coolers which are arranged with substantially parallel oil flow circuits with their corresponding flow outlet locations positioned near the front-to-rear center of the diesel engine block. An important part of the present invention is the cooperating configuration of the coolant flow cavity (i.e. manifold) which has a tapering design, front-to-rear, and provides balanced coolant delivery to all cylinders.

One of the important considerations in the design of a diesel engine is how to provide lubricating oil to the critical areas of the engine. A related consideration is how to direct and route the engine coolant to the engine cylinders. There is a relationship between the design of the oil cooler, the coolant flow path and the delivery of oil and coolant to various portions of the engine, such as the engine cylinders. The oil cooler may be placed at some location in the coolant flow loop in order to lower the temperature of the oil before delivery to the main oil rifle. Further, the coolant needs to be routed to critical areas of the engine in a way that provides efficient and balanced cooling. In particular, coolant delivery to the cylinders needs to be equalized in the sense of delivery and heat transfer so as to create a balanced and uniform cooling design whereby all of the cylinders are able to operate at substantially the same temperature.

Lubricating oil needs to be routed to engine areas such as the main bearings, rod bearings, piston cooling nozzles, valve trains, and camshaft gear train. The effectiveness of the lubricating oil depends in part on the oil temperature. In order to adequately address the heat transfer which occurs as the lubricating oil flows over and around these critical engine components, it is important to place an oil cooler in the lubricating oil flow loop. In one variation of a typical diesel engine arrangement, oil from the sump is first pumped to a full flow filter and from there to an inlet of the oil cooler. An alternative arrangement and one which is representative of that which is used with the present invention, routes the oil to the oil cooler and thereafter to the full flow oil filter. Typically a thermostat-controlled by-pass valve is positioned upstream from the inlet to the oil cooler and this valve is designed to route the oil around the oil cooler when the oil temperature is not high enough to require cooling (i.e., has not reached operating temperature).

Various arrangements of lubricating oil flow paths, oil filters and by-pass options are typically found in different diesel engine designs and different sized engines. However, the focus of the present invention is directed to a specific oil cooler design, its specific placement within the flow circuit, and the corresponding coolant delivery configuration. Therefore, a full explanation of the many variations for a range of diesel engine designs is not necessary. It is important to understand that the coolant delivery configuration, including the specific design of the coolant cavity, is an important aspect of the present invention.

In one typical type of lubricating oil flow circuit, the oil cooler is an elongated member which includes a series of closely stacked cooling fins with a continuous, single pass oil flow conduit extending therethrough. Lubricating oil from the oil sump (or full flow filter) enters the oil cooler at one end and traverses through the flow conduit to an opposite end outlet location. The oil cooler is typically positioned along the side of the engine block in a recessed cavity which cavity is in flow communication with the engine coolant. The cooling fins of the oil cooler are exposed directly to the engine coolant for effecting the required heat transfer and cooling of the lubricating oil. Another option for the oil cooler arrangement is to use a compact oil cooler design with the fins disposed toward the front end of the engine block. However, this design causes a higher horsepower draw and thus represents one type of parasitic loss.

In those designs where the oil cooler is elongated and extends for a majority of the block length, it has been discovered that there is a substantial pressure drop across the length of the oil cooler. This pressure drop is considered to be too great to be acceptable with the adverse consequence that it unnecessarily increases parasitic losses. A further fact learned about the elongated oil cooler version when combined with a typical coolant arrangement is that most of the heat transfer takes place in the very beginning section at the start of the flow path through the oil cooler.

In order to improve on coolant distribution to the engine cylinders and to decrease lubrication system and coolant system parasitic losses, the present invention was conceived. In the present invention, two oil coolers are used, and these two oil coolers are positioned end to end so as to generally simulate the physical configuration of an elongated oil cooler. An elongated coolant cavity is cast into the engine block with a front to rear tapering design along the lower surface. The flow of coolant is thereby made more uniform and balanced as it flows to each cylinder. The oil flow enters the front portion of the front cooler and in a parallel manner enters the-rear portion of the rear cooler. The flow passes through each oil cooler toward the middle of the engine and then to the oil filter head where the oil is filtered and then sent back across the engine in between the two oil coolers and to the main oil rifle. One advantage of this arrangement for the oil circuit is that the cooled oil comes in to the center of the main oil rifle and provides a more even distribution. Another advantage of the present invention involves the unique design of the tapered coolant flow manifold so that the flow of coolant to the oil coolers (flow over the fins) is relatively even and is able to provide more uniform and balanced cooling to the engine.

Two separate oil coolers have been used at least once in the K19 diesel engine design of Cummins Engine Company of Columbus, Ind. In the K19 engine configuration, the oil coolers are not elongated to extend end-to-end the full length of the block. There is therefore more of a restriction and greater parasitic losses as a consequence. Further, while the flow paths through these two K19 oil coolers are parallel, the flow entry is at the front end of each cooler with a flow exit (outlet) at the rear of each cooler. The entering flows are split and the exiting flows are combined. Of importance when considering this K19 design is the fact that in the K19 engine design, the exiting flows do not come out near the center of the block, but rather pass to the rear of the engine to connect with the main oil rifle. With front to back flow, the end cylinders have been found to run hotter than the front cylinders. Clearly, this K19 arrangement does not provide the more balanced and even distribution which is one of the advantages of the present invention. A further difference between the present invention and the K19 engine is the rearwardly tapered coolant cavity (i.e. manifold) and the resultant coolant flow paths to each cylinder. This design provides a more uniform and balanced flow of coolant to each cylinder.

In addition to the K19 engine arrangement there are various patent references which disclose a variety of cooler designs and cooling concepts. The following listed patent references are believed to provide a representative sampling of such earlier patented designs:

| PATENT NO. | PATENTEE | ISSUE DATE |
|---|---|---|
| 1,310,251 | Russell | Jul. 15, 1919 |
| 1,931,935 | Paugh | Oct. 24, 1933 |
| 2,063,782 | Barnes | Dec. 8, 1936 |
| 2,525,191 | Warrick et al. | Oct. 10, 1950 |
| 2,623,612 | Scheiterlein | Dec. 30, 1952 |
| 4,041,697 | Coffinberry et al. | Aug. 16, 1977 |
| Japanese Patent No. 4-103826 | | Apr. 6, 1992 |

SUMMARY OF THE INVENTION

A dual oil cooler arrangement for positioning in a tapered coolant flow cavity of a diesel engine block according to one embodiment of the present invention comprises an elongated front oil cooler positioned toward the front portion of the engine block, the front oil cooler having an oil inlet adjacent its forward end and an oil outlet adjacent its rearward end, an elongated rear oil cooler positioned toward the rear portion of the engine block, the rear oil cooler having an oil inlet adjacent its rearward end and an oil outlet adjacent its forward end, a flow conduit network connecting the oil inlets in a parallel flow pattern with a supply source of oil and connecting the oil outlets with an oil filter, and the engine block having an approximate midpoint between the front portion and the rear portion such that the oil outlets are positioned adjacent this engine midpoint. The tapered coolant flow cavity functions as a coolant manifold delivering coolant to each cylinder. The front to rear narrowing taper creates a more balanced and uniform flow of coolant to each cylinder thereby creating an improved coolant flow circuit.

One object of the present invention is to provide an improved oil cooler and engine coolant arrangement.

Related objects and advantages of the present invention will be apparent from the following description.

DESCRIPTION OF THE PREFERRED EMBODIMENT

Figure 1:
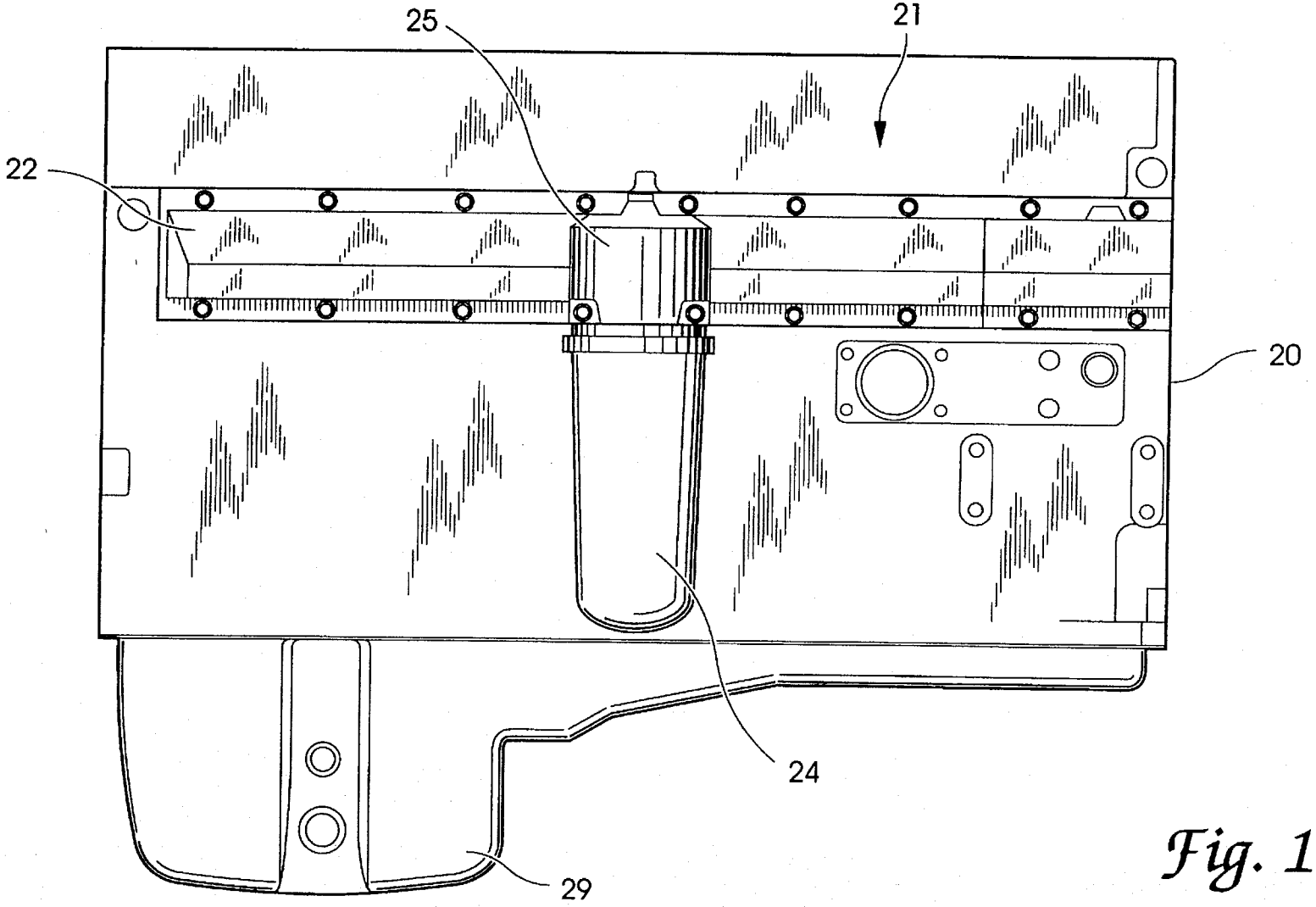
FIG. 1 is a side elevational view of a diesel engine block into which an oil cooler assembly designed according to a typical embodiment of the present invention has been installed.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is illustrated a diesel engine block 20 which incorporates an oil cooler arrangement 21 which is positioned in the block 20 beneath outer cover 22. Outer cover 22 comprises a portion of the overall oil cooler arrangement 21 due to the various flow apertures and conduits which are formed into outer cover 22 (see FIGS. 4–7). These various flow apertures and conduits accommodate the flow of oil.

The oil which flows into and through oil cooler arrangement 21 passes through two oil coolers in a split flow pattern. The corresponding two exit flows are combined and routed through oil filter 24. Oil filter 24 is securely received by fitting 25. Fitting 25 is a portion of the unitary casting which provides outer cover 22.

In FIG. 1, the engine block 20 has only been illustrated in part and might be regarded as more diagrammatic in nature. The intent is to provide a general idea of where the oil cooler arrangement 21 is positioned relative to a typical engine block. Oil pan 29 is illustrated as an aid in understanding the orientation of the engine block 20, the location of outer cover 22 and the positioning of oil filter 24. Any specific engine block details or features which may have been omitted are not relevant to an understanding of the present invention.

Figure 2:
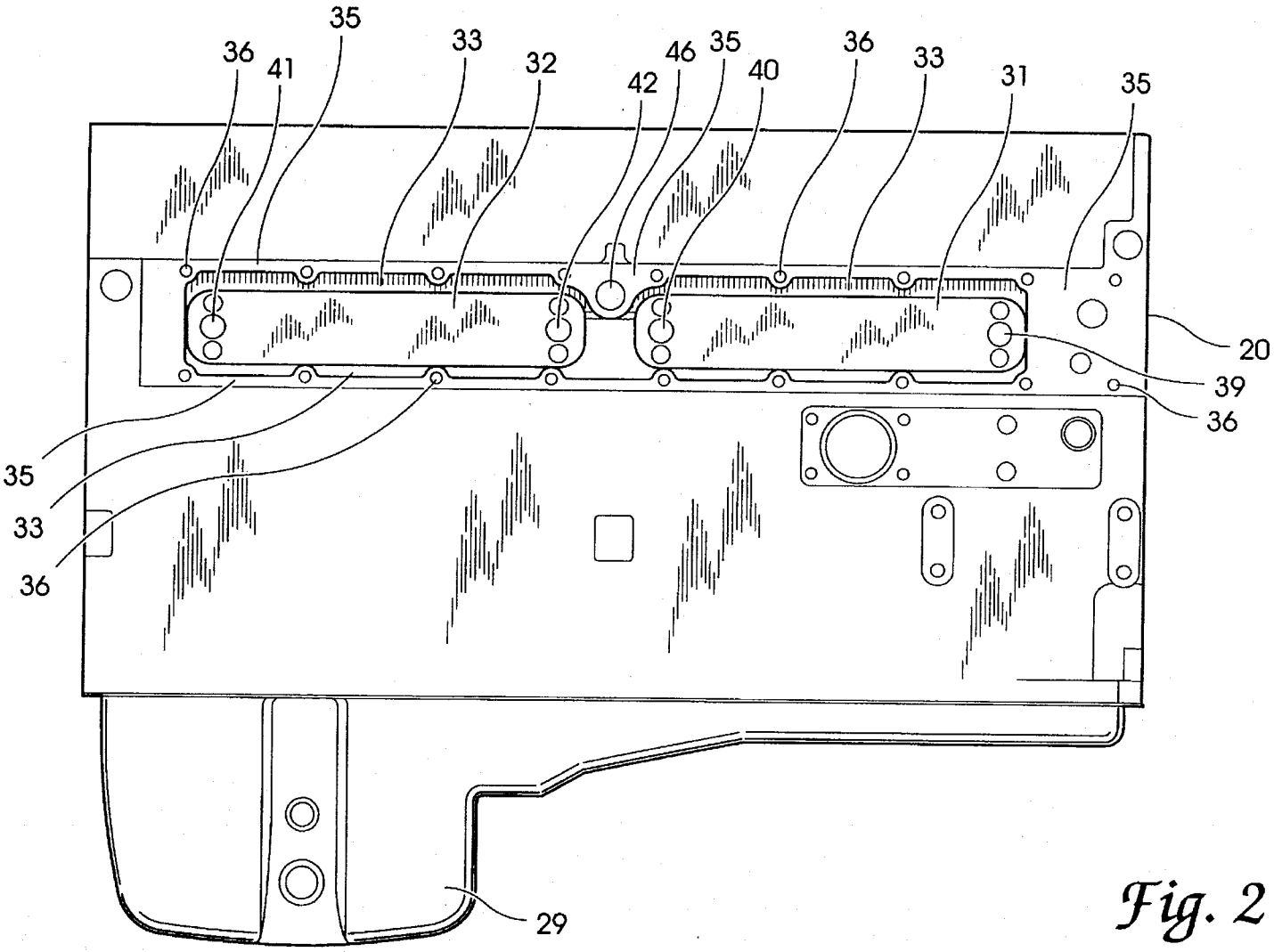
FIG. 2 is a side elevational view of the FIG. 1 engine block with the outer cover for the oil cooler assembly removed.

Referring to FIG. 2, the FIG. 1 illustration of the engine block 20 and oil cooler arrangement 21 is repeated, but now with the outer cover 22 removed in order to reveal the two oil coolers 31 and 32. The two oil coolers 31 and 32 are securely attached to the inside surface of cover 22, spaced apart by a sealing gasket (not illustrated). Oil coolers 31 and 32 are arranged end-to-end in a manner which results in two, generally symmetrical or parallel flow loops. Each oil cooler 31 and 32 is positioned inside flow cavity 33 which is a cast-in, longitudinal recess disposed in engine block 20. Oil cooler 31 is the "front" cooler and oil cooler 32 is the "rear" cooler (applying normal engine orientation terms).

The outer edge, peripheral lip surface 35 of cavity 33 represents a smoothly machined surface with a pattern of eighteen (18) spaced-apart, internally threaded bolt locations 36. These bolt locations correspond to the eighteen (18) mounting (clearance) holes in outer cover 22. Positioned between surface 35 and outer cover 22 are suitable seals and gaskets, typically in longitudinal sheet form, as would be appropriate in order to establish a fluid-tight and sealed interface between the outer cover 22 and engine block 20 completely around peripheral lip surface 35.

Oil coolers 31 and 32 are virtually identical in size, shape and construction and each one has an oblong shape. A plurality of spaced fins with flow conduits therethrough comprise the heat exchange approach for each oil cooler. In each oil cooler hot oil is routed through the flow conduits from one end to the opposite end. As the oil flows, heat from the oil is conducted from the surrounding aluminum conduit to the stacked aluminum fins. The large surface area of the fins provides an excellent heat transfer mechanism. Coolant flowing across, over and around the fins draws off some of the heat from the fins thereby raising the temperature of the coolant and enabling the fins to accept and in turn transfer more heat from the lubricating oil.

The oil flow paths associated with each oil cooler 31 and 32 begin with the delivery of oil from an oil pump (not illustrated) to each oil cooler. The oil is initially delivered by way of a thermostat control valve (see FIG. 10) which senses to see if there is sufficient heat in the oil to require cooling. If the oil is not hot enough to require cooling, based upon the predetermined threshold temperature on the thermostat control valve, it bypasses the oil coolers 31 and 32 and flows directly to oil filter 24. From the oil filter 24 the oil is routed to the main oil rifle and from there to those areas of the engine which require cooling lubrication.

One of the differences between the present invention and certain prior art arrangements involves the use of two, virtually identical, oil coolers which are arranged end-to-end in a parallel flow network. Another difference is the elongated size (length) of each oil cooler 31 and 32 and the fact that when placed end-to-end, they extend for virtually the entire length of engine block 20. A further difference between the present invention and the prior art is the specific flow entry and exit locations for each oil cooler. As is illustrated in FIG. 2 and diagrammatically illustrated in FIG. 10, the front oil cooler 31 has a forward oil inlet 39 and a rearward oil outlet 40. The rear oil cooler 32 has a rearward oil inlet 41 and a forward oil outlet 42.

If the incoming oil requires cooling, the oil flows into inlet 39 of the front oil cooler 31 and in parallel therewith into inlet 41 of the rear oil cooler 32. A passageway 45 (see FIGS. 5–10) routes the oil flow to the rear oil cooler 32. The oil flow through each oil cooler is virtually the same except for the direction of flow. The oil flowing through the front oil cooler 31 is from the front to the rear while the oil flowing through the rear oil cooler 32 is from the rear to the front. What occurs as a result of this arrangement is that the two-oil flows exit from their corresponding oil coolers toward the middle of the engine block. The two flows which are almost side-by-side at this point are combined and introduced into oil filter 24. The filtered oil is then routed from the filter to the main oil rifle via passageway 46 for distribution to other portions of the engine. A key advantage of this flow path is that the cooled and filtered oil comes into the approximate center of the main oil rifle and provides a more even distribution of the cooled lubricating oil.

Figure 3:
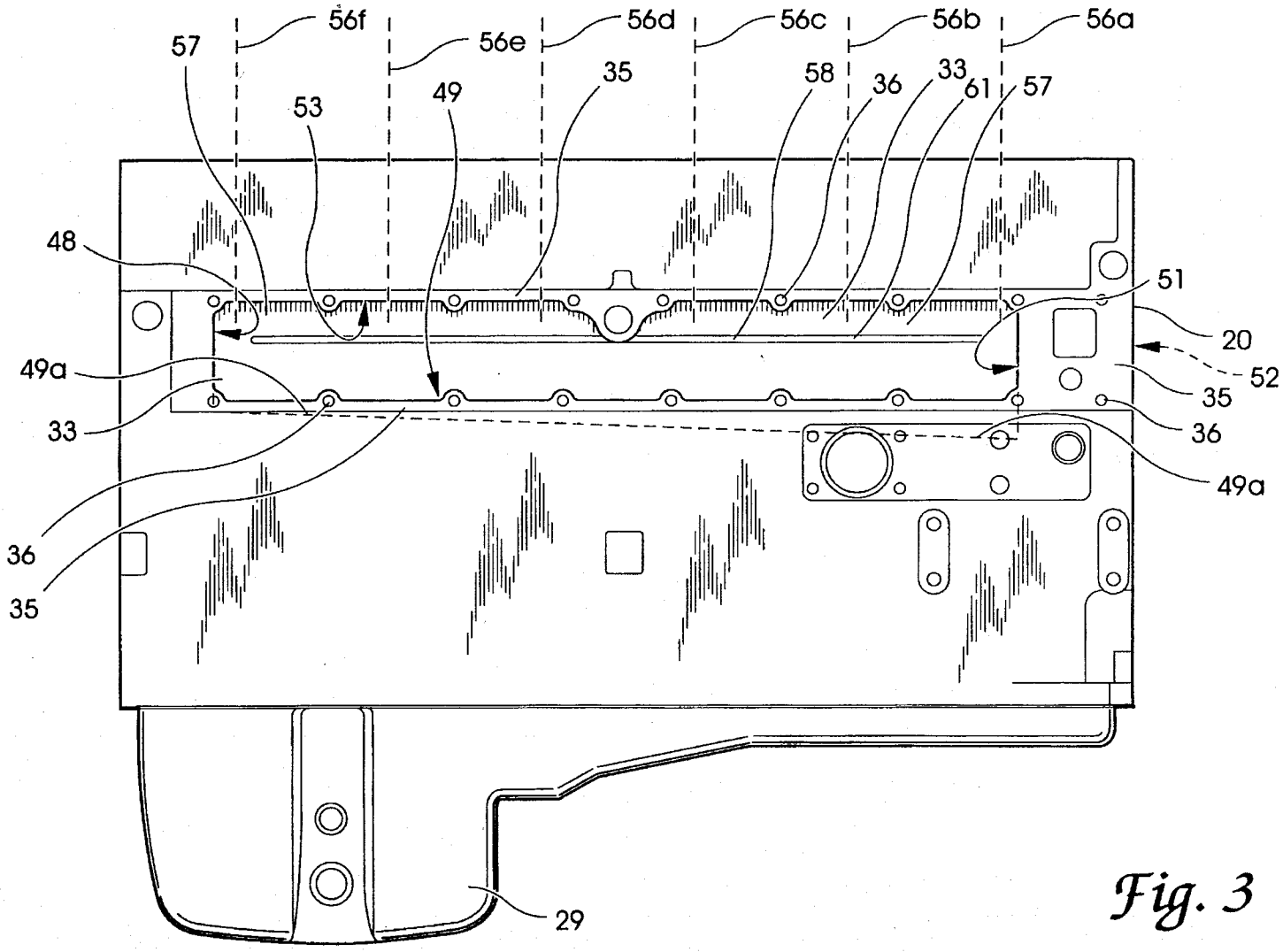
FIG. 3 is a side elevational view of the FIG. 2 engine block with the two elongated oil coolers removed.
Figure 4:
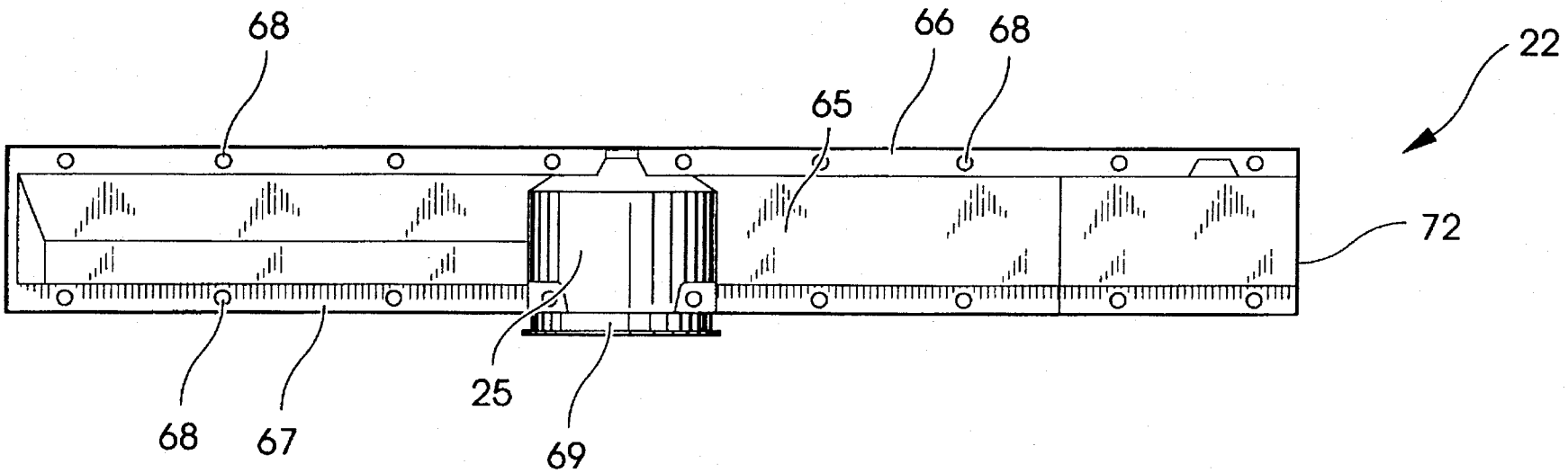
FIG. 4 is a front elevational view of the outer cover for the FIG. 1 oil cooler assembly.
Figure 5:
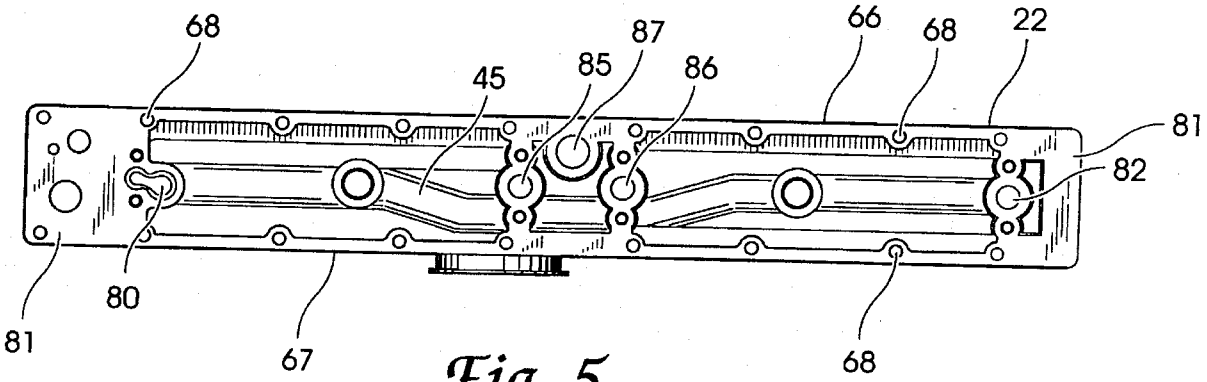
FIG. 5 is a rear elevational view of the FIG. 4 oil cooler outer cover.
Figure 6:
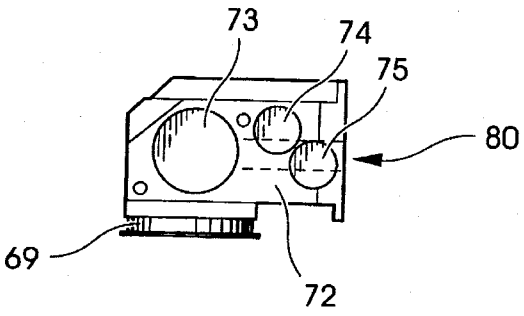
FIG. 6 is a right end elevational view of the FIG. 4 oil cooler outer cover.
Figure 7:
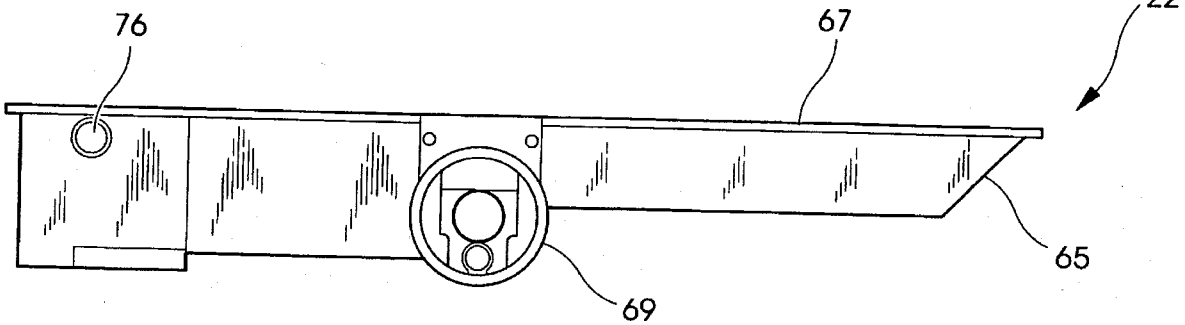
FIG. 7 is a bottom plan view of the FIG. 4 oil cooler outer cover.

Referring now to FIG. 3, the FIG. 2 illustration of the engine block 20 and oil cooler arrangement 21 is repeated, but now with the two oil coolers 31 and 32 removed so as to reveal the size, shape and configuration of flow cavity 33. Flow cavity 33 is configured as an elongated recess which is cast into engine block 20. The designed function of flow cavity 33 is to provide a cavity for receipt of the two oil coolers 31 and 32 with a sufficient clearance volume around the two oil coolers to enable adequate heat transfer circulation of engine coolant. The specific design of flow cavity 33 is also directed to creating and controlling a particular coolant flow path for more balanced and uniform coolant delivery to each of the engine cylinders.

Flow cavity 33 is closed in at end wall 48 and along bottom (surface) wall 49. At front end wall 51 there is a cast-in flow passageway 52 for the incoming engine coolant. Along upper wall 53 there is an opening into the plenum chamber where the six cylinders are located. The exit flow path is diagrammatically illustrated by the six broken lines **56*a*–56*f*, one for each cylinder, even though there is open flow. The proximal side of flow cavity 33 is open and surrounded by peripheral lip surface 35. The distal side or portion is closed off by cast wall 57. Cast into distal wall 57 is a longitudinally-running, outwardly-extending rib 58. Rib 58 begins at a location near the front end of flow cavity 33 and extends to a location just short of end wall 48. Although somewhat difficult to illustrate, it is to be understood that the height of the flow cavity 33 from bottom wall 49 to upper wall 53 uniformly decreases from front end wall 51 to rear end wall 48. Since upper wall 53 is substantially flat, the uniformly varying depth is created by providing a taper to bottom wall 49. This taper which is diagrammatically illustrated by broken line 49*a* is substantially uniform throughout its length. Comparing the height of the flow cavity 33 at its two endpoints of walls 51 and 48, the difference in height measures approximately 1.5 inches (3.8 cm). The highest section of cavity 33 (in the plane of the paper) is adjacent to end wall 51 while the shallowest section is adjacent to end wall 48**.

The outer edge 61 of rib 58 sets the locating depth into cavity 33 from surface 35 for oil coolers 31 and 32. Therefore, rib 58 must establish the same depth (normal to the plane of the paper) throughout its length relative to surface 35. As a result of this arrangement, when the two oil coolers 31 and 32 are installed, they abut up against outer edge 61 and fit precisely within cavity 33. This precise fit enables the outer cover 22 and related accessories, such as gaskets and seals, to be installed without any unacceptable interference. This combination is then bolted in place through the aligned patterns of eighteen (18) holes.

The decreasing tapered shape of flow cavity 33 creates a smaller, decreasing cross-sectional area as the cavity extends from end wall 51 to end wall 48. In effect there is a decreasing volume which influences the flow path for the engine coolant which is introduced into cavity 33 adjacent end wall 51. As the coolant begins to circulate in, over and around oil cooler 31, its ultimate flow path has two options. As one option the coolant, or at least a portion of it, may flow rearward through flow cavity 33 to the remainder of oil cooler 31 and then on to oil cooler 32. As the other option for the engine coolant, or at least a portion of it, it may flow out through the exit flow passage that connects with the plenum chamber where the cylinders are located. The coolant flow in the direction of the first cylinder is denoted by broken line **56*a*. This particular flow path which is in direct communication with flow cavity 33** and with the corresponding engine cylinder serves to accept the upward flowing coolant (actually only a portion of the coolant).

What has been discovered by the right balancing of flow volume and rate, the size and shape of cavity 33, its rate of taper from front to rear and the exit flow denoted by broken lines **56*a*–56*f* is that a substantially uniform and balanced flow of engine coolant will be directed in a direct path to and around each engine cylinder. Although the remainder volume of cavity 33 to the left of broken line 56*a* is relatively large in comparison to the size of the exit flow passageway corresponding to line 56***a*, the tapering design of cavity 33 creates a flow restriction which causes a portion of the circulating engine coolant to be diverted to the first engine cylinder.

As the coolant continues to circulate around oil cooler 31 as the coolant flows toward end wall 48, the same type of flow division occurs at the approximate location of the next cylinder which is represented by broken line 56*b*. Although there is less of a restriction in flow cavity 33 due to the shorter remaining length at the location of line 56*b*, there is effectively less flow pressure due to what is diverted off by way of the line 56*a* passageway. The result of this arrangement is that a portion of the engine coolant is diverted and flows directly to the corresponding engine cylinder which in this case would be the second cylinder. This same scenario is played out for the remaining four (4) cylinders and the corresponding flows which are denoted by broken lines 56*c*–56*f*. It is to be noted that while a six-cylinder engine has been illustrated the particular flow separation and diversion as described would be applicable for any number of engine cylinders. As the flow travels the length of the flow cavity 33 heat transfer is fairly balanced and a portion of the engine coolant is diverted to a corresponding engine cylinder through the opening connecting flow cavity 33 with the plenum chamber where the cylinders are located.

What has been learned is that the flow rate and volume of engine coolant in each individual flow path which is diverted out of flow cavity 33 to the various engine cylinders is substantially the same as to volume and flow rate and cooling capacity. Each engine cylinder receives a substantially uniform and balanced portion of the engine coolant regardless of the cylinder location. There is not a problem of too much coolant being diverted to the first few cylinders and not enough remaining for the last few cylinders nor is there any significant difference in the coolant temperature at each cylinder. There are in effect no cylinders running hotter than any other cylinders due to the coolant flow arrangement of the present invention. Without the tapered design of flow cavity 33 and the specific flow network with the various flow paths, it is common for the coolant which is delivered to the various cylinders to be non uniform. The result is an imbalance in the cylinder temperatures and this imbalance detracts from engine efficiency. In the long term this imbalance and inefficiency can lead to more serious engine problems. The present invention provides not only a unique oil cooler arrangement but a most advantageous coolant arrangement.

A related design aspect of the present invention also involving the tapered design of flow cavity 33 is the uniformity of the coolant flowing up, over and around the various fins of each oil cooler. This flow is balanced over the length of each oil cooler. Flow cavity 33 acts as a coolant distribution manifold and the uniform flow over the oil coolers corresponds with the uniform and balanced flow to each cylinder. By balancing the flow and heat transfer within flow cavity 33 there is a higher probability that the temperature of the coolant flowing to each cylinder will be substantially the same as well as having a coolant flow rate which is substantially the same.

Referring to FIGS. 4–7 there is illustrated in greater detail outer cover 22. Outer cover 22 includes a main cover portion 65 which is bounded on the top by upper mounting flange 66 and on the bottom by lower mounting flange 67. Each mounting flange includes nine (9) spaced-apart mounting (clearance) holes 68. These eighteen (18) mounting holes are located for alignment with the eighteen (18) bolt locations 36. Fitting 25 extends upwardly from cover portion 65 and includes a generally cylindrical portion 69 (see FIG. 7) which provides the interface for oil filter 24.

Front end 72 (see FIG. 6) provides the location for the thermostat control valve and the connecting passageways to a pressure regulator. Cylindrical opening 73 provides the location for the thermostat control valve, as previously mentioned, and opening 74 is provided for a pressure regulator plunger. Openings 75 and 76 (see FIG. 7) are provided for oil flow to the regulator.

If the entering oil is below the threshold temperature established by the thermostat control valve located in opening 73, the entering oil will flow directly to oil filter 24, bypassing the two oil coolers 31 and 32. The passageway for the by-passing flow is machined into outer cover 22. When the entering oil is to be directed to the two oil coolers 31 and 32, the entering oil flows from the thermostat control valve in opening 73 through a small portion of the outer cover and exits from aperture 80 for one oil cooler and from aperture 82 for the other oil cooler. Apertures 80 and 82 are disposed in machined surface 81. With the oil cooler arrangement 21 properly assembled and installed in engine block 20, aperture 80 is aligned with forward oil inlet 39 of the front oil cooler 31. Passageway 45 concurrently routes a portion of the entering oil through the outer cover 22 to aperture 82. Aperture 82 is in alignment with rearward oil inlet 41 of rear oil cooler 32. By the secure abutment of the outer cover to the engine block and with the proper interface of seals and gaskets, an oil flow path is established from the outer cover into each oil cooler 31 and 32.

After the oil flows through the front oil cooler 31 it returns to the outer cover due to the alignment of oil outlet 40 with aperture 85. The previously described parallel flow path through rear oil cooler 32 exits from oil outlet 42 into aperture 86. Apertures 85 and 86 represent passageways to the inlet of oil filter 24. Once the two oil flow paths are merged and filtered, the oil exits from the filter into outer cover 22. The exiting oil flows from the outer cover by way of aperture 87 and enters passageway 46 which is machined into the engine block and which communicates directly with the main oil rifle at a somewhat centralized location.

Figure 8:
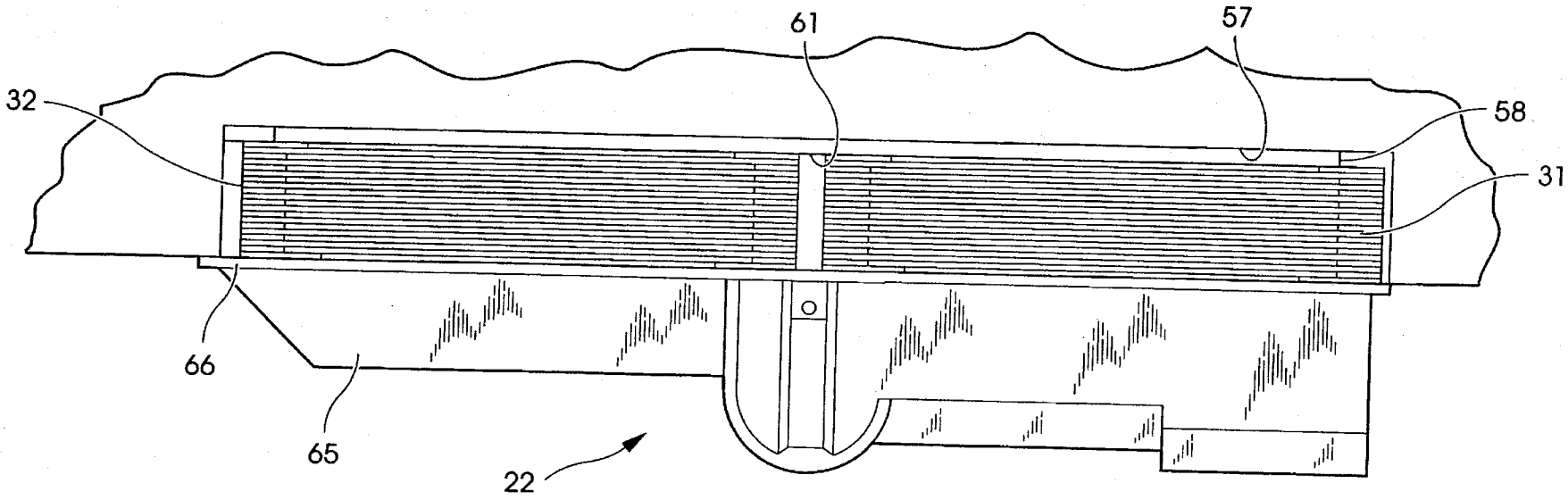
FIG. 8 is a fragmentary, top plan view of the FIG. 1 oil cooler assembly as installed in the engine block according to the present invention.

With reference to FIG. 8, a fragmentary, top plan view of the oil cooler arrangement 21 is illustrated. This diagrammatic representation reveals the manner in which oil coolers 31 and 32 fit into flow cavity 33 and their abutment up against the outer surface 61 of rib 58. The outer edge 61 of rib 58 provides a substantially flat abutment surface as a seat for oil coolers 31 and 32 which are assembled to cover 22. The spacing between outer edge 61 and distal wall 57 provides a flow space for the engine coolant to work its way through, over and around the fins of each oil cooler.

Figure 9:
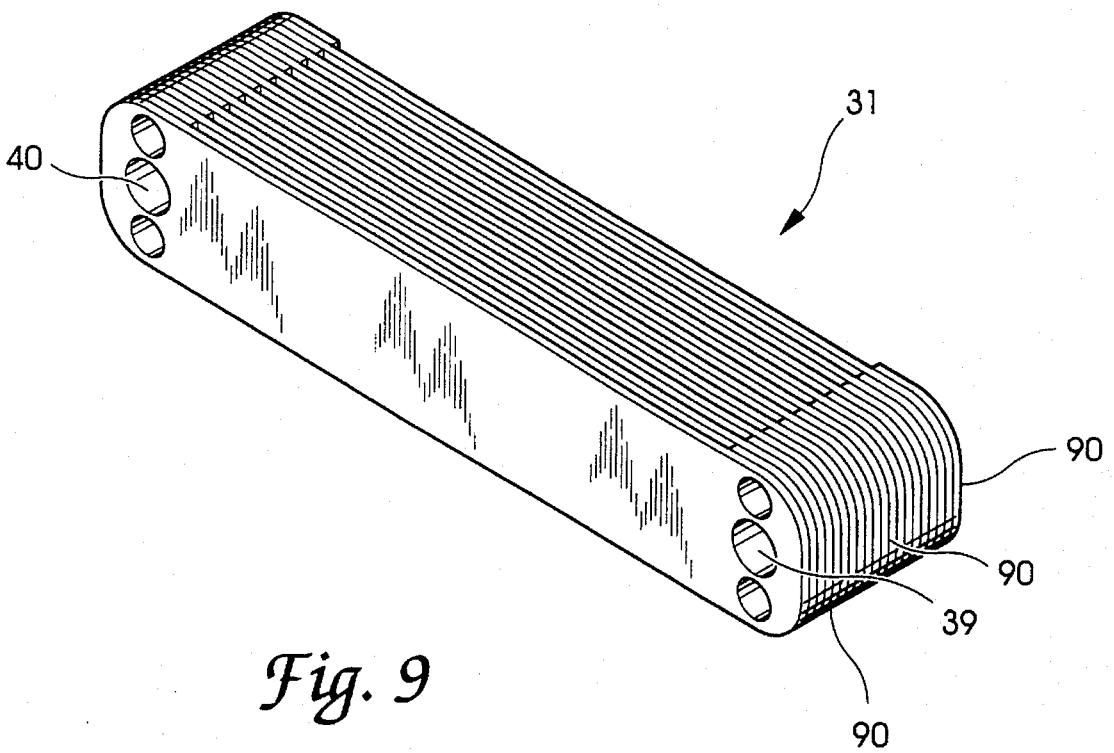
FIG. 9 is a perspective view of one oil cooler which is suitable for use as part of the present invention.

Referring briefly to FIG. 9, a perspective view of one oil cooler is illustrated. While oil cooler 31 has been identified, it is to be understood that oil cooler 32 is virtually identical. Oil cooler 31 includes oil inlet 39 and oil outlet 40. These apertures represent the starting and ending points of an enclosed conduit which winds its way through the stacked series of fins 90. Each oil cooler includes ten (10) fins which are similarly shaped and uniformly spaced apart from each other. The spacing between adjacent fins 90 is approximately equal to the thickness of each fin 90.

Figure 10:
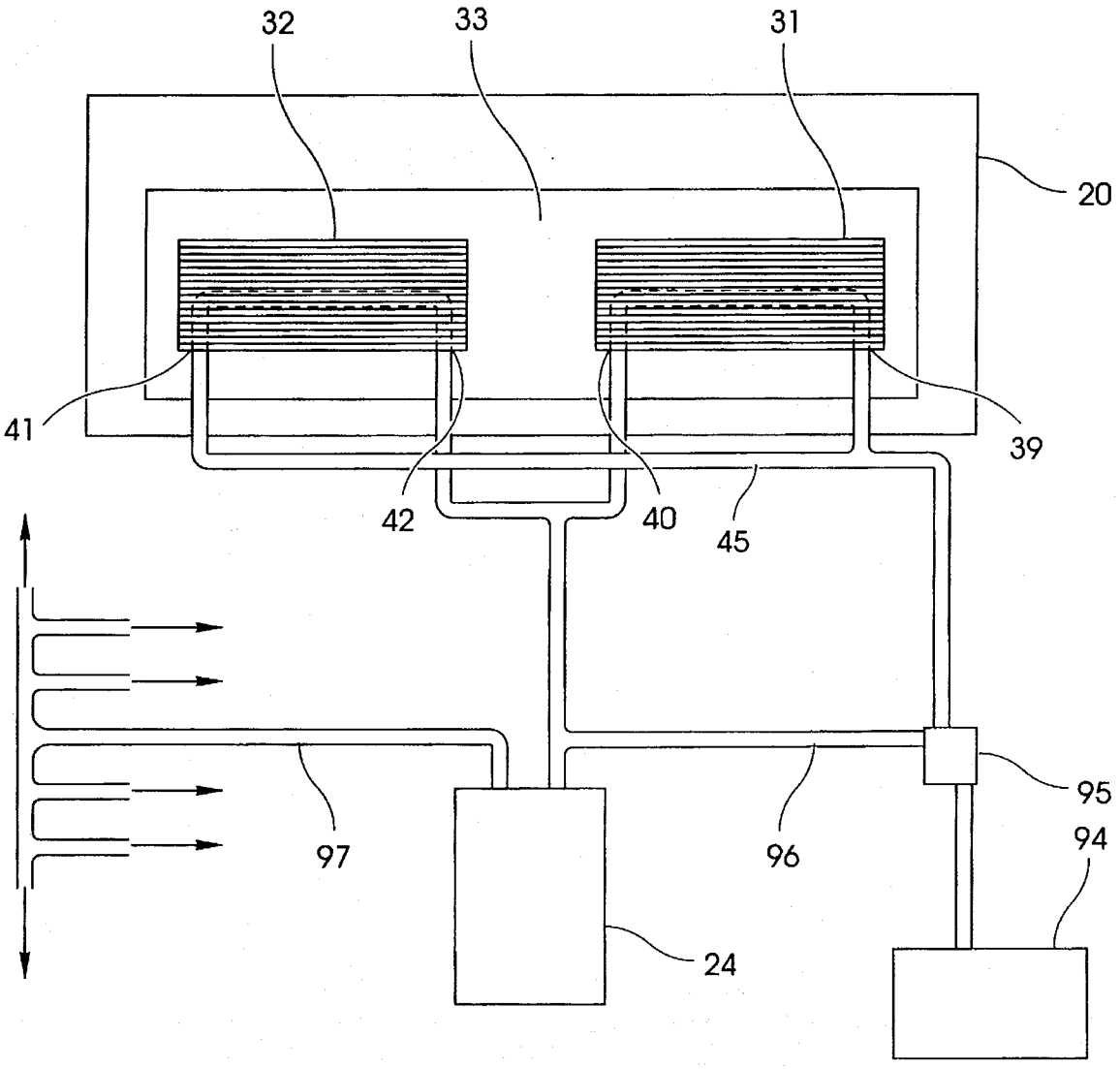
FIG. 10 is a schematic illustration of the overall flow path network for the oil side according to the present invention.

In FIG. 10 the oil flow network of the present invention is illustrated as a schematic diagram. Included in FIG. 10 are representations for a lube pump 94, thermostat control valve 95, by-pass conduit 96 and main oil rifle 97. The remaining portions of the FIG. 10 illustration are numbered so as to correspond to the structural elements previously described.

The thermostat control valve directs the incoming oil through either by-pass conduit 96 or into passageway 45. Conduit 96 leads directly to oil filter 24.

Passageway 45 is in flow communication with the oil inlet of each oil cooler 31 and 32. The two flow paths of oil exiting from the oil coolers enter the oil filter 24. The filtered oil leaving the oil filter 24 is routed by the main oil rifle 97 to remote portions of the engine. There are various arrow paths on each branch depicting separate flows from the main oil rifle. These flows are directed to the main bearings, the rod bearings, piston cooling jets and the camshaft gear train. These flows are examples of the exit points from the main oil rifle.

Figure 11:
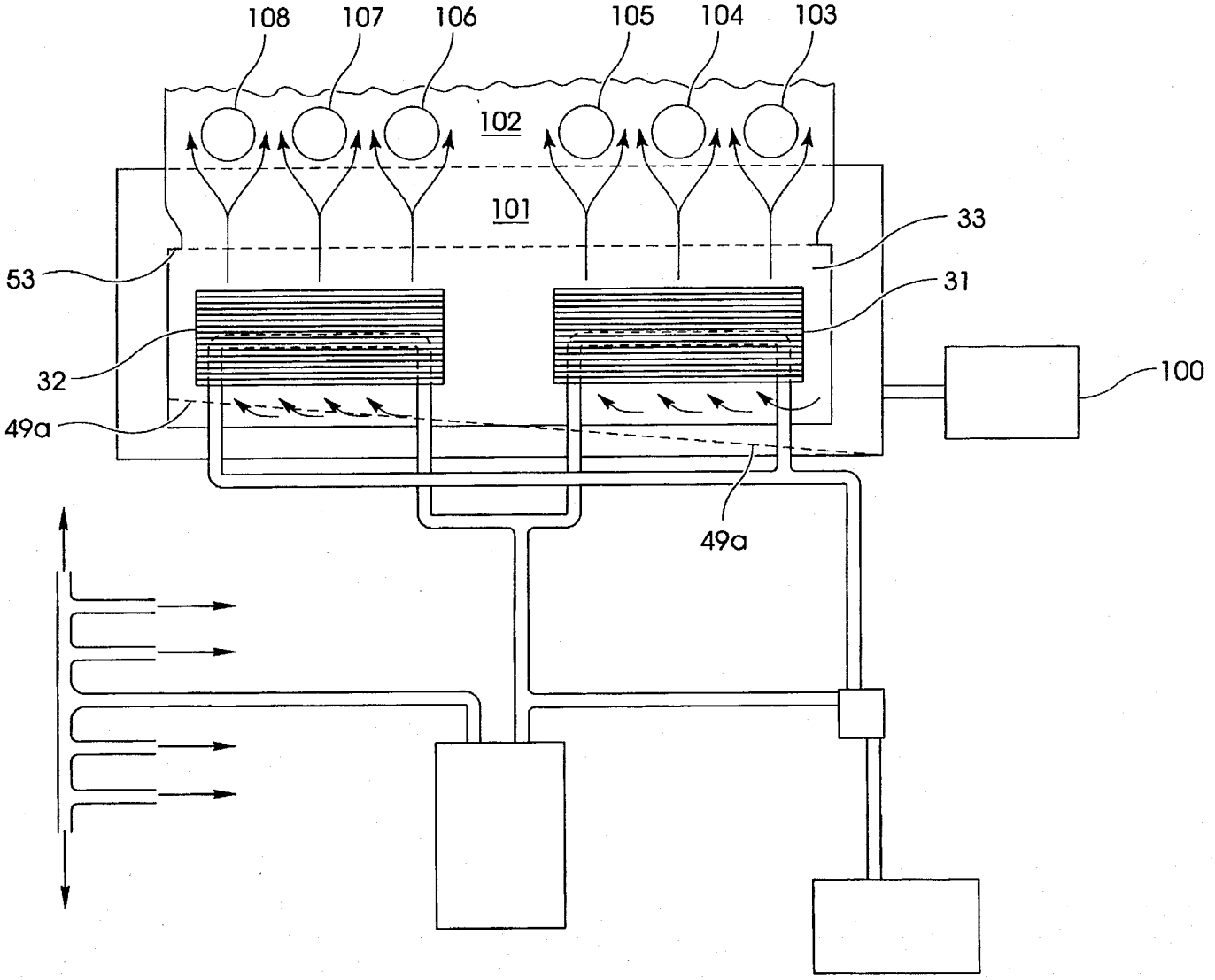
FIG. 11 is a schematic illustration of the overall flow path network for the coolant side according to the present invention.

Referring briefly to FIG. 11, the FIG. 10 schematic illustration has generally been repeated. However, in the FIG. 11 illustration the various arrows represent the various flow paths for engine coolant and the oil flow path arrows have been removed. In the FIG. 11 illustration, the coolant side of the overall flow network is illustrated. A water pump 100 represents the introduction of coolant into flow cavity 33. Upper wall 53 includes a flow opening 101 which is in communication with plenum chamber 102 in which the six engine cylinders 103–108 are located. Although the engine cylinders have been illustrated as circular outlines, it is to be understood that this particular cylinder orientation is actually turned 90 degrees from their normal orientation relative to the engine block. In fact, these cylinders would be in a upright orientation and the drawing has been specifically modified in order to be able to show the flow of coolant against and around the individual cylinders.

The various flow arrows have been styled in such a way as to generally correspond with broken lines **56*a*–56*f* as illustrated in FIG. 3. Although flow opening 101 is completely open through the upper wall 53, individual flow lines have been used previously in this description as a means of focusing on the flow portion which goes to each of the six cylinders. In the FIG. 11 illustration, the flow arrows are split off of a portion of the flow passing through flow opening 101 into plenum chamber 102. This split flow goes around the corresponding cylinder. The remaining portions of FIG. 11 are the same as those illustrated in FIG. 10** which depicted the oil or lubrication side of the overall flow network of the present invention.

The structure of the present invention having been described, including some of the advantages and benefits, further performance features and relationships will now be described. The present invention includes a water or coolant side portion to the flow network and an oil or lubrication side portion. These two portions of the overall flow network cooperate with each other by the tapered design of the flow cavity 33 and the placement of the two elongated oil coolers 31 and 32 into the flow cavity in an end-to-end relationship. The tapered flow cavity 33 and the spaced, exit flow path in upper wall 53 provide a structure which distributes the coolant evenly to each engine cylinder. Cavity 33 serves as a coolant distribution manifold, as has been described. The flow network eliminates any significant conduit bends as well as any significant locations of expansion or contraction. The oil coolers and the flow cavity (coolant manifold) help to direct the coolant flow upwardly into the passageways leading to each engine cylinder.

On the lubrication (oil) side, the pair of elongated oil coolers 31 and 32 create an oil cooler arrangement which extends for a majority of the length of the engine block. The larger cooling surface area of the fins provides excellent heat transfer. The arrangement of two oil coolers with parallel flow loops results in less pressure drop and minimal flow turbulence as compared to a single flow path of equivalent length. The exiting flow at the center of the block directly into the oil filter yields a smoother flow with fewer bends and turns. The two oil flow paths are merged together upon entry into the oil filter 24 and thereafter enter the main oil rifle at a more central location.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A dual oil cooler arrangement for positioning in a coolant flow cavity of a diesel engine block, the block having a front portion and opposite thereto a rear portion, said dual oil cooler arrangement comprising:

an elongated front oil cooler positioned toward the front portion of said engine block, said front oil cooler having an oil inlet adjacent a forward end of said front oil cooler and an oil outlet adjacent a rearward end of said front oil cooler;

an elongated rear oil cooler positioned toward the rear portion of said engine block, said rear oil cooler having an oil inlet adjacent a rearward end of said rear oil cooler and an oil outlet adjacent a forward end of said rear oil cooler;

a flow conduit network connecting said oil inlets in a parallel flow pattern with a supply source of oil and connecting said oil outlets with an oil filter; and said engine block having an approximate midpoint between said front portion and said rear portion, said oil outlets being positioned adjacent said block midpoint.

2. The dual oil cooler arrangement of claim 1 wherein said coolant flow cavity is recessed and elongated and tapered so as to have a forward to rearward decreasing size.

3. The dual oil cooler arrangement of claim 1 wherein said flow conduit network includes an outer cover assembled over said coolant flow cavity.

4. The dual oil cooler arrangement of claim 3 which further includes a thermostat control valve assembled into said outer cover.

5. The dual oil cooler arrangement of claim 3 wherein said coolant flow cavity is recessed and elongated and tapered so as to have a forward to rearward decreasing size.

6. The dual oil cooler arrangement of claim 5 which further includes a thermostat control valve assembled into said outer cover.

7. The dual oil cooler arrangement of claim 5 wherein said outer cover provides an inlet passageway for entering oil and an inlet/outlet fitting for said oil filter.

8. The dual oil cooler arrangement of claim 3 wherein said outer cover provides an inlet passageway for entering oil and an inlet/outlet fitting for said oil filter.

9. The dual oil cooler arrangement of claim 8 which further includes a thermostat control valve assembled into said outer cover.

10. The dual oil cooler arrangement of claim 9 wherein said coolant flow cavity is recessed and elongated and tapered so as to have a forward to rearward decreasing size.

11. A coolant distribution and lubricating oil arrangement cooperatively positioned in an engine block, said arrangement comprising:

a recessed flow cavity defined by said engine block, said flow cavity having a front to rear tapered shape and a decreasing size;

a front oil cooler positioned toward the front portion of said engine block, said front oil cooler having an oil inlet adjacent a forward end of said front oil cooler and an oil outlet adjacent a rearward end of said front oil cooler;

a rear oil cooler positioned toward the rear portion of said engine block, said rear oil cooler having an oil inlet adjacent a rearward end of said rear oil cooler and an oil outlet adjacent a forward end of said rear oil cooler;

a flow conduit network connecting said oil inlets in a parallel flow pattern with a supply source of oil and connecting said oil outlets with an oil filter; and said engine block defining a plenum chamber for a plurality of engine cylinders and a connecting opening in flow communication with said flow cavity for routing coolant to a plurality of said engine cylinders, said connecting opening being arranged along said flow cavity from front to rear whereby the flow of coolant to each cylinder is substantially balanced for substantially uniform cooling.

12. The coolant distribution and lubricating oil arrangement of claim 11 wherein said flow conduit network includes an outer cover assembled over said coolant flow cavity.

13. The coolant distribution and lubricating oil arrangement of claim 12 which further includes a thermostat control valve assembled into said outer cover.

14. The coolant distribution and lubricating oil arrangement of claim 13 wherein said outer cover provides an inlet passageway for entering oil and an inlet/outlet fitting for said oil filter.

15. The coolant distribution and lubricating oil arrangement of claim 12 wherein said outer cover provides an inlet passageway for entering oil and an inlet/outlet fitting for said oil filter.

* * * * *